US007119054B2

(12) United States Patent
Housmekerides et al.

(10) Patent No.: US 7,119,054 B2
(45) Date of Patent: Oct. 10, 2006

(54) AQUEOUS COMPOSITIONS COMPRISING PROTEASE AND/OR AMYLASE

(75) Inventors: Chris Efstathios Housmekerides, Ludwigshafen (DE); Daniele Fregonese, Ludwigshafen (DE)

(73) Assignee: Reckitt Benckiser Inc, Parsippany, NJ (US)

( * ) Notice: Subject to any disclaimer, the term of this patent is extended or adjusted under 35 U.S.C. 154(b) by 337 days.

(21) Appl. No.: 10/381,069

(22) PCT Filed: Sep. 18, 2001

(86) PCT No.: PCT/GB01/04138

§ 371 (c)(1),
(2), (4) Date: Jul. 8, 2003

(87) PCT Pub. No.: WO02/24851

PCT Pub. Date: Mar. 28, 2002

(65) Prior Publication Data

US 2004/0023833 A1 Feb. 5, 2004

(30) Foreign Application Priority Data

Sep. 20, 2000 (GB) ..... 0023054

(51) Int. Cl.
*C11D 3/00* (2006.01)
*C11D 7/42* (2006.01)

(52) U.S. Cl. ..... 510/393; 510/392; 510/393; 510/527; 510/530; 510/533

(58) Field of Classification Search ..... 510/305, 510/418, 320, 392, 393, 527, 530, 533
See application file for complete search history.

(56) References Cited

U.S. PATENT DOCUMENTS 5,587,356 A 12/1996 Dauderman et al. ..... 510/320
5,679,630 A * 10/1997 Baeck et al. ..... 510/305
6,281,187 B1 * 8/2001 Smerznak ..... 510/418

FOREIGN PATENT DOCUMENTS

| | | | |
|---|---|---|---|
| EP | 0 199 405 | | 10/1986 |
| EP | 0 451 924 | A2 | 10/1991 |
| EP | 0 462 460 | A2 | 12/1991 |
| GB | 2 140 819 | A | 12/1984 |
| GB | 2 178 054 | A | 2/1987 |
| GB | 2 298 211 | A | 8/1996 |
| WO | 93 11215 | | 6/1993 |
| WO | 98 05748 | | 2/1998 |
| WO | WO 99/00477 | * | 1/1999 |
| WO | 99 21954 | | 5/1999 |

OTHER PUBLICATIONS

PCT International Search Report, dated Jan. 18, 2002, for PCT/GB01/04138.

GB Search Report, dated Feb. 16, 2001, for GB 0023054.0.

Derwent Abstract, Database WPI, Section Ch, Week 199445, XP-002187409.

Derwent Abstract, Database WPI, Section Ch, Week 197504, XP-002187408.

* cited by examiner

*Primary Examiner*—Lorna M. Douyon
*Assistant Examiner*—Preeti Kumar
(74) *Attorney, Agent, or Firm*—Norris McLaughlin & Marcus, PA

(57) ABSTRACT

An enzyme-containing laundry booster composition in which the enzyme is stabilized by a system comprising a boron compound, an alkali metal salt of an aliphatic hydroxydi- or hydroxylic-carboxylic acid and an alkali metal chloride. A preferred additional stabilizing ingredient is a $C_8$–$C_{18}$ alcohol alkoxylated with about 3 to 6 moles of ethylene oxide.

10 Claims, No Drawings

AQUEOUS COMPOSITIONS COMPRISING PROTEASE AND/OR AMYLASE

This application is a 371 national phase application of PCT/GB01/04138 filed on Sep. 18, 2001, claiming priority to GB 0023054.0 filed on Sep. 20, 2000, the contents of which are incorporated herein by reference in their entirety.

This invention relates to aqueous enzyme-containing laundry booster compositions for use either as a pre-wash composition or in conjunction with a laundry detergent.

Enzyme-containing laundry booster compositions have been known for many years. A major problem encountered with such compositions has been irreversible decay of enzyme activity during storage caused by the denaturization of the enzymes. This problem is particularly acute when such compositions have to be transported or stored under conditions where temperatures of 40° C. or higher are encountered. Numerous enzyme stabilization systems have been developed over the years but there is still room for improvement in such systems, particularly as regards cost effectiveness.

It is therefore a primary object of this invention to develop stabilized enzyme-containing laundry booster composition which incorporates a low cost, but effective, stabilization system. It is also an object of this invention to develop an enzyme-containing composition which is effective against a wide variety of stains encountered in daily life such as blood, wine, grass and chocolate.

Surprisingly, it has now been found that, by providing an enzyme stabilization system comprising (1) a boron compound, (2) an alkali metal salt of an aliphatic hydroxydi- or hydroxytri-carboxylic acid, and (3) an alkali metal chloride, in which ingredients (2) and (3) are present in higher amounts than have generally been heretofore used, enhanced stabilization of the enzyme is obtained. By the further addition of a nonionic surfactant in the form of $C_8$–$C_{18}$ alcohol alkoxylated with about 3 to 6 moles of ethylene oxide, further improvements in enzyme stabilization are attained, as well as an improvement in the efficacy of enzyme-containing compositions as stain removers.

The invention, in its first aspect, is directed to a laundry booster composition comprising by weight:

(a) from about 0.05% to about 5% of a protease and/or an amylase enzyme, (b) an enzyme stabilization system comprising:

(1) from about 0.005% to about 3.0% of a boron compound selected from boric acid, boric oxide, alkali metal borates and mixtures thereof, (2) from about 5.0% to about 20% of an alkali metal salt of an aliphatic hydroxydi- or hydroxytri-carboxylic acid having from 1 to 4 hydroxy groups and from 4 to 8 carbon atoms, and (3) from about 2% to about 15% of an alkali metal chloride, said percentages being based on the entire composition, and (c) sufficient amount of an alkali hydroxide to attain a pH in the range of from 7.0 to 8.5.

In a preferred embodiment, the enzyme stabilizing system (b) additionally comprises:

(4) from about 0.05%-to about 5% of a $C_8$–$C_{18}$ alcohol alkoxylated with about 3 to 6 moles of ethylene oxide.

In another preferred embodiment, the aqueous enzyme composition additionally comprises:

(d) from about 0.5% to 10% of an organic solvent selected from alcohols, diols, glycols and glycol ethers, each having from 1 to 8 carbon atoms.

Further, the invention is also directed to the use of the aforementioned enzyme stabilization system to stabilize enzyme-containing laundry booster compositions and enzyme-containing laundry detergent compositions. And the invention is also directed to the use of the above-described enzyme compositions as a laundry booster.

The enzymes suitable for use in the compositions include protease and amylase enzymes.

The proteolytic enzymes suitable for the present compositions include the various commercial liquid enzyme preparations which have been adapted for use in association with detergent compositions. Enzyme preparations in powdered form are also useful although, as a general rule, less convenient for incorporation into liquid compositions. Suitable liquid enzyme preparations include "Alcalase", "Savinase", and "Esperase", all trademarked products sold by Novo Industries, Copenhagen, Denmark, and "Maxatase", "Maxacal", and "AZ-Protease" and "Properase" sold by Gist-Brocades, Delft, The Netherlands.

Among the suitable alpha-amylase liquid enzyme preparations are those sold by Novo Industries and Gist-Brocades under the tradenames "Termamyl" and "Maxamyl", respectively.

Mixtures of proteolytic and amylase enzymes can and often are used to assist in removal of different types of stains.

The proteolytic enzyme and/or amylase enzyme will normally be present in the compositions in an effective amount in the range of from about 0.05% to about 5%, preferably from about 0.5% to about 2%, by weight of the composition. Generally, lower levels of amylase are required.

The boron compound required in the enzyme stabilization system is a compound capable of yielding boric acid and is, preferably, boric acid itself. Examples of compounds capable of producing boric acid are boric oxide and sodium borate (borax). The boron compound is introduced in amounts of from about 0.05 to about 3.0 weight %, based on the weight of the entire enzyme-containing composition. Preferably, the boron compound is used in amounts of from 0.1% to 2.0%, and more preferably, in amounts of from 0.3% to 1.0%.

Exemplary as the salt of the hydroxycarboxylic acid is sodium citrate which is preferred because of its ready availability and contribution to improving physical to improving the physical stability of the composition—i.e., preventing phase separation, as well as providing efficacy against oxidizable stains, e.g., coffee and wine stains. However, other hydroxydi- or hydroxytri-carboxylic acids can be employed, such as malic acid, tartaric acid, isocitric acid or tri-hydroxyglutaric acid. The preferred sodium citrate is conveniently used in the form of its dihydrate. Alternatively, citric acid itself may be used in formulating the compositions. However, since the compositions are at an alkaline pH, the hydroxydi- or hydroxytri-carboxylic acid will be present in its ionized salt state. This ingredient is used in an amount ranging of about 5% to about 20% of the entire enzyme-containing composition, preferably amounts of from 8% to 15%, and more preferably in amounts of from 10% to 13%.

The alkali metal chloride used in the enzyme stabilization system is preferably sodium chloride. This ingredient is used in an amount of from about 2% to about 15% based on the weight of the entire enzyme-containing composition, preferably, the chloride ingredient is used in amounts ranging from 4% to 12%, and more preferably from 5% to 8%.

The preferred enzyme-containing compositions also contain from about 0.05% to about 5% of a $C_8$–$C_{18}$ alcohol alkoxylated with 3 to 6 moles of ethylene oxide. A wide variety of alkoxylated fatty alcohols are known to the art and these vary considerably in HLB (hydrophile-lipophile balance). For purposes of this invention, it is preferable to employ an alkoxylated alcohol which is relatively hydrophobic. Preferred surfactants are fatty alcohols having from about 8 about 15 carbon atoms, alkoxylated with about 4 to 6 moles of ethylene oxide. A particularly preferred surfactant is that sold under the trademark Lialet 125 and has a formulation of $C_{12}$–$C_{15}$ alcohols alkoxylated with 5 moles of ethylene oxide. These nonionic surfactants are preferably present in the enzyme-containing compositions of this invention in amounts ranging from 0.1% to 2%, more preferably from 0.3% to 1%.

To bring the pH to within the desired range of 7.0 to 8.5, a sufficient amount of alkali hydroxide, preferably sodium hydroxide, is added.

The compositions of this invention desirably also contain at least one organic solvent which is preferably water-miscible. Such useful organic solvents include: the linear alcohols such as ethanol, isopropanol and the isomers of butanol; diols; glycols such as ethylene glycol, propylene glycol and hexylene glycol; glycol ethers, etc. Low molecular weight solvents, i.e., those from 1 to 8 carbon atoms, are preferred. A particularly preferred solvent is propylene glycol.

In order to provide desirable rheologic characteristics to the composition of this invention, thickeners should be added. These include polymeric substances which function as viscosity stabilizers and aid in enzyme stabilization. Exemplary of such polymeric compositions are polyacrylic acid, polymethacrylic acid, acrylic/methacrylic acid copolymers, hydrolyzed polyacrylamide, hydrolyzed polymethacrylamide, hydrolyzed polyacrylonitrile and hydrolyzed polymethacrylonitrile. Water soluble salts or partial salts of these polymers, as well as their respective alkali metal or ammonium salts can also be used. A preferred polymeric substance is sold under the trademark Polygel DA, which is a polyacrylic acid having a molecular weight greater than 1,000,000. These polymers are used in amounts ranging from about 0.1% to 1%, preferably about 0.4%.

A preferred thickening agent is xanthan gum which may be present in an amount of from between 0.1% and 0.5%, preferably about 0.3%. In addition to providing beneficial viscosity characteristics to the compositions, xanthan gum also assists in the removal of certain stains.

The stabilized enzyme-containing compositions of this invention can also include the usual additives usually present in compositions of this type provided, of course, that they do not detract from enzyme stability. Such additives include perfumes, dyes, preservatives, antibacterial agents, fluorescent whitening agents and pigments.

Suitable preservatives include the isothiazolinones sold under the trademark Kathon DP3 and available from Rohm & Haas.

In a second aspect of this invention, the enzyme-containing compositions also comprise suspended particles which differ in colour or shade from the aqueous liquid composition. These particles (speckles) can serve an aesthetic purpose and can also provide an additional amount of enzyme stabilizer to the composition. Speckles can be present in amounts ranging from about 0.01 to about 1.0 weight percent, preferably from about 0.01 to about 0.5 weight percent. Typically, they will consist of a solid material which can function as an additional stabilizing agent, a coating which melts at a suitable temperature, and a small amount of dye. Particularly useful are speckles having from about 40% to about 60% of citric acid as a core material and hydrogenated vegetable fat as a coating. The coating should be chosen so that it has a melting point within the range of the water temperature intended to be used for washing. Thus, if a product is intended for use in hot water washing, a suitable hydrogenated vegetable fat would melt at a temperature of about 56° C.

The viscosity of any composition containing speckles should be adjusted by way of thickeners, etc., so that speckles remain homogeneously suspended in solution.

The following examples are illustrative of the compositions of this invention.

EXAMPLE 1

Speckles (Particles) Containing Citric Acid Having the Following Composition

| Ingredient | wt. % |
|---|---|
| citric acid (core) | 50.0 |
| hydrogenated vegetable fat (coating; m.p. 56°) | 49.8 |
| Sandoplast Blue 2B (dye) | 0.2 |

This composition was used as the speckles ingredient in the following examples.

EXAMPLE 2

An Aqueous Enzyme Composition was Prepared Having the Following Ingredients

| Ingredient | wt. % |
|---|---|
| Deionized water | 75.679 |
| Boric acid | 0.500 |
| Isothiazolinone(1) | 0.100 |
| Polyacrylic Acid(2) | 1.000 |
| Sodium citrate dihydrate | 11.400 |
| Oxo Alcohols $C_{12}$–$C_{15}$ + 5 EO(3) | 0.500 |
| Sodium chloride | 7.000 |
| Monopropylene glycol | 3.000 |
| Xanthan gum | 0.200 |
| Properase 1600 L(4) | 0.350 |
| Canish 175342 B(5) | 0.170 |
| Acid Blue 9 (Basacid Blue 756 liquid)(6) | 0.001 |
| Speckles | 0.100 |
| Total | 100.00 |

(1)Kathon DP3, Rohm & Haas Company
(2)Polygel DA, 3V Sigma Company
(3)Lialet 125, Condea Company
(4)Product of Gist-Brocades
(5)Perfume, Firmenich
(6)Dye

EXAMPLE 3

A variant of the composition of Example 2 as prepared in which there was added as a fluorescent whitening agent, CBS-X is a chemical name for 4,4'-bis(2-sulphostyryl) diphenyl. The amount of water was reduced to 75.629%.

Performance Testing

In performance tests, the compositions of Examples 2 and 3 were shown to be effective against stains comprising blood, grass, wine, coffee and chocolate.

The invention claimed is:

1. An aqueous enzyme containing laundry booster composition comprising by weight:

a) from about 0.05% to about 5% of a protease and/or an amylase enzyme, b) an enzyme stabilization system comprising:

1) from about 0.005% to about 3.0% of a boron compound selected from boric acid, boric oxide, alkali metal borates and mixtures thereof, 2) from about 5.0% to about 20% of an alkali metal salt of an aliphatic hydroxydi- or hydroxytri-carboxylic acid having from 1 to 4 hydroxy groups and from 4 to 8 carbon atoms, and 3) from about 2% to about 15% of an alkali metal chloride, c) sufficient amount of an alkali hydroxide to attain a pH in the range of from 7.0 to 8.5; and d) from about 0.0 1% to about 1.0% speckles comprising 1) a solid core ingredient comprising citric acid coated with hydrogenated vegetable fat; and 2) a dye.

2. A laundry booster composition according to claim 1 in which the enzyme stabilization system (b) additionally contains:

4) from about 0.05% to about 5% of a $C_8$–$C_{18}$ alcohol alkoxylated with about 3 to 6 moles of ethylene oxide.

3. A laundry booster composition according to claim 1 which additionally comprises:

from about 0.5% to 10% of an organic solvent selected from alcohols, diols, glycols and glycol ethers, each having from 1 to 8 carbon atoms.

4. A laundry booster composition according to claim 2 which additionally comprises:

from about 0.5% to 10% of an organic solvent selected from alcohols, dials, glycols and glycol ethers, each having from 1 to 8 carbon atoms.

5. A laundry booster composition according to claim 1 in which the enzyme is a protease enzyme.

6. A laundry booster composition according to claim 4 which comprises:

(a) from 0.1% to 1.0% of the enzyme, (b)(1) from 0.1% to 2.0% of the boron compound, (b)(2) from 8% to 15% of the alkali metal salt of an aliphatic hydroxydi- or hydroxytri- carboxylic acid, (b)(3) from 4% to 12% of the alkali meted chloride, (b)(4) from 0.3% to 3% of the alkoxylated alcohol, and from 1% to 8% of the organic solvent.

7. A laundry booster composition according to claim 4 which comprises:

(a) from 0.1% to 1.0% of the enzyme, (b)(1) from 0.1% to 2.0% of the boron compound, (b)(2) from 8% to 15% of the alkali metal salt of an aliphatic hydroxydi- or hydroxytri- carboxylic acid, (b)(3) from 4% to 12% of the alkali metal chloride, (b)(4) from 0.1% to 3% of the alkoxylated alcohol, and from 1% to 8% of the organic solvent.

8. A laundry booster composition according to claim 6 comprising:

(a) from 0.2% to 0.5% of the protease enzyme, (b)(1) from 0.3% to 1.0% of the boron compound, (b)(2) from 10% to 13% of the alkali metal salt of an aliphalic hydroxydi- or hydroxytri- carboxylic acid, (b)(3) from 5% to 8% of the alkali metal chloride, (b)(4) from 0.3% to 1.0% of the alkoxylated alcohol, from 2% to 5% of the organic solvent.

9. A laundry booster composition according to claim 1 in which an effective amount of an alkali hydroxide is added to bring the pH to a range of from 7.0 to 7.5.

10. A laundry booster composition according to claim 8 in which the boron compound (b)(1) is boric acid, the alkali metal salt of an aliphalic hydroxydi- or hydroxytri- carboxylic acid, (b)(2) is sodium citrate, the alkali metal chloride (b)(3) is sodium chloride, the alkoxylated alcohol (b)(4) is a $C_{12}$–$C_{15}$ alcohol alkoxylated with about 5 moles of ethylene oxide, the alkali metal hydroxide (c) is sodium hydroxide, and the organic solvent is propylene glycol.

* * * * *